US007087184B2

(12) United States Patent
Kintz et al.

(10) Patent No.: US 7,087,184 B2
(45) **Date of Patent: *Aug. 8, 2006**

(54) MR FLUID FOR INCREASING THE OUTPUT OF A MAGNETORHEOLOGICAL FLUID DEVICE

(75) Inventors: K. Andrew Kintz, Apex, NC (US); Teresa L. Forehand, Raleigh, NC (US)

(73) Assignee: Lord Corporation, Cary, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/289,071

(22) Filed: Nov. 6, 2002

(65) Prior Publication Data

US 2004/0084651 A1 May 6, 2004

(51) Int. Cl.
*H01F 1/44* (2006.01)

(52) U.S. Cl. ..... 252/62.52

(58) Field of Classification Search ..... 252/62.52, 252/62.56, 62.55

See application file for complete search history.

(56) References Cited

U.S. PATENT DOCUMENTS

| | | | |
|---|---|---|---|
| 2,805,997 | A | 9/1957 | Benoit, Jr., et al. |
| 4,164,473 | A | 8/1979 | Coupland et al. |
| 4,889,647 | A | 12/1989 | Rowan et al. |
| 5,137,647 | A | 8/1992 | Karol |
| 5,277,281 | A | 1/1994 | Carlson et al. |
| 5,284,330 | A | 2/1994 | Carlson et al. |
| 5,390,121 | A | 2/1995 | Wolfe |
| 5,398,917 | A | 3/1995 | Carlson et al. |
| 5,412,130 | A | 5/1995 | Karol |
| 5,492,312 | A | 2/1996 | Carlson |
| 5,547,049 | A | 8/1996 | Weiss et al. |
| 5,627,146 | A | 5/1997 | Tanaka et al. |
| 5,634,969 | A | 6/1997 | Cody et al. |
| 5,645,752 | A | 7/1997 | Weiss et al. |
| 5,670,077 | A | 9/1997 | Carlson et al. |
| 5,711,746 | A | 1/1998 | Carlson |
| 5,816,372 | A | 10/1998 | Carlson et al. |
| 5,842,547 | A | 12/1998 | Carlson et al. |
| 5,878,871 | A | 3/1999 | Miesner |
| 5,988,336 | A | 11/1999 | Wendt et al. |
| 6,027,664 | A | 2/2000 | Weiss et al. |
| 6,254,661 | B1 | 7/2001 | Takeda et al. |

*Primary Examiner*—C. Melissa Koslow
(74) *Attorney, Agent, or Firm*—Todd W. Galinski

(57) ABSTRACT

What is disclosed is a magnetorheological fluid useful for incorporating within the working gap of magnetorheologically controllable linear or rotary devices. The MR fluid includes a carrier fluid component and a magnetic responsive particle component characterized by $D_{10}$ of 2 μm up to and including a $D_{10}$ of 5 μm, a $D_{50}$ of 8 μm up to and including $D_{50}$ of 15 μm; a $D_{90}$ of 25 μm to and including a $D_{90}$ of 40 μm; and further characterized by least squares regression ($R^2$) particles size against log normal cumulative volume percent of greater than or equal to 0.77. Optional preferred additives included therewith include thixotropic agent or viscosity modifier, dispersant or surfactant, antioxidant, corrosion inhibitor, and one or more lubricants.

18 Claims, 5 Drawing Sheets

MR FLUID FOR INCREASING THE OUTPUT OF A MAGNETORHEOLOGICAL FLUID DEVICE

BACKGROUND OF THE INVENTION

Magnetorheological (MR) devices of the "rotary-acting" or "linear-acting" variety such as linear dampers, rotary brakes and rotary clutches employ magnetorheological fluids within the working gap that are comprised of magneto-soft particles or as such particles dispersed within a liquid carrier and referred to as MR fluids. The higher the applied magnetic field strength, the higher the damping or resistive force or torque needed to overcome the particle structure.

MR fluid devices are disclosed in U.S. Pat. No. 5,816,372 entitled "Magnetorheological Fluid Devices And Process Of Controlling Force In Exercise Equipment Utilizing Same"; U.S. Pat. No. 5,711,746 entitled "Portable Controllable Fluid Rehabilitation Devices"; U.S. Pat. No. 5,842,547 entitled "Controllable Brake"; U.S. Pat No. 5,878,871 entitled "Controllable Vibration Apparatus" and U.S. Pat. Nos. 5,547,049, 5,492,312, 5,398,917, 5,284,330, and 5,277,281, all of which are commonly assigned to the assignee of the present invention.

The present invention as a device includes a housing or chamber that contains the magnetically controllable fluid disclosed herein below, with a movable member, a piston or rotor, mounted for movement through the fluid in the housing. The housing and the movable member both include a magnetically permeable pole piece. A magnetic field generator produces a magnetic field across both pole pieces for directing the magnetic flux to desired regions of the controllable fluid. Such devices require precisely toleranced components, expensive seals, expensive bearings, and a relatively small volume of magnetically controllable fluid. MR devices provide as currently designed are comparatively expensive to manufacture. There is a continuing need for reducing the cost of controllable MR devices for providing variable forces and/or torques.

Conventional MR fluids containing magnetically active fine particles generally on the order of 1–100 μm average diameter employ conventional iron particles manufactured by the carbonyl process, whereby particles are grown by precipitation of pentacarbonyl salts. Magnetorheological fluids have been manufactured that employ magnetically active particles manufactured by an atomization method, which is a reductive process of dividing a molten metal stream into small particles. The molten metal stream is delivered into a high pressure, high velocity stream and divided by high shear and turbulence (hereinafter collectively referred to as "atomized particles").

Due to performance and cost concerns, suitable replacement for expensive carbonyl iron by atomized particles has not been a straightforward substitution. In conventional practice heretofore, atomized particles of a single process stream have been sieved to exclude a significant fraction of 10–20% of particles larger than 74 μm. In other instances, an even larger fraction of 20–30% of a single process yield of atomized particles greater than 45 μm size must be excluded to render the population useful for magnetically controllable devices. Yields below 90% are considered uneconomical.

Attempts have been made to blend atomized particles with carbonyl iron particles to achieve a suitable particle size distribution for use in MR devices. Heretofore, attempts to provide 100% of particles passing through a 74 μm sieve and approaching a Gaussian distribution have been achieved by blending particles from more than one process stream.

U.S. Pat. No. 6,027,664 (Lord Corporation) teaches blends of a first population having an average particle diameter 3 to 15 times larger than the second population. Such mixtures are uneconomical in part because yield losses from the atomized process are carried over from classification or sieving. The suitability of any particulate metals for use in MR fluids is in one respect determined by analyzing the degree of deviation from a Gaussian distribution, and can be illustrated by a regression analysis. Mixtures of two different populations heretofore taught in the art also approach a Gaussian distribution but doe not equal the distribution provided by carbonyl iron powders. For example, a 50:50 wt. mixture of carbonyl iron and water-atomized particles available as of the filing date of the '664 patent deviate from a log normal size distribution with an $R^2$ of 0.82. Although technically feasible, the particle blends heretofore available suffer from economic drawbacks. A need therefore exists for particles utilized in MR devices utilizing atomized particles of a single process stream in higher yield of useable particles with improved distribution, which has heretofore not been met. It would be advantageous to provide a MR fluid containing a particle component derived from a single economical process yield having a population of magnetically responsive particles exhibiting a useful size distribution for improving economic factors in controllable devices.

SUMMARY OF THE INVENTION

In accordance with the invention magnetorheological fluids employed in magnetically controllable devices are disclosed, and a method for controlling a magnetic field-responsive device by using single process atomized particles defined by particles having a 10% volume fraction ($D_{10}$) of 2 μm, 3 μm, 4 μm, and up to and including a $D_{10}$ of 5 μm; a 50% volume fraction ($D_{50}$ diameter) of 8 μm, 9 μm, 10 μm, 11 μm, 12 μm, 13 μm, 14 μm, up to and including a $D_{50}$ of 15 μm; and a 90% volume fraction ($D_{90}$) of 25 μm up to and including a $D_{90}$ of 40 μm. The single process atomized particle population is further characterized by a least squares regression from log normal particle size against cumulative volume % (R 2) of greater than or equal to 0.77.

A preferred aspect of the invention is directed to magnetorheological fluid useful within an MR device comprising a volume percent of carrier fluid, and a volume percent of magnetically responsive particles from a single atomization process stream, and at least one additive that reduces the interparticle friction, wherein the magnetic-responsive particles exhibit a $D_{10}$ of 2, 3, 4 or 5 μm, a $D_{50}$ of 10 μm up to and including $D_{50}$ of 13 μm, and a $D_{90}$ of 28 up to and including a $D_{90}$ of 35 μm, the population is also characterized by a $R^2$ least squares regression of log normal particle size against cumulative volume % of greater than or equal to 0.77.

The invention is related to co-pending Ser. No. 10/288,769, entitled Improved MR Devices, filed on Nov. 6, 2002 and directed to magnetorheological devices, in particular linear or rotary devices and haptic control systems.

DETAILED DESCRIPTION OF THE INVENTION

Particle Component

As used herein, the particle component is defined as the portion of the magnetorheological fluid that is comprised of a single process yield population of magnetically responsive particles characterized by a 10 vol. % ($D_{10}$) of 2 μm up to and including a $D_{10}$ of 5 μm; a 50 vol. % (D50) of 8 μm up to and including a $D_{50}$ of 15 μm; and a 90 vol. % ($D_{90}$) of 25 μm up to and including a $D_{90}$ of 40 μm; and the population is further characterized by an R2 against the least squares regression line of cumulative volume percent versus log particle size of from 0.77 and higher. Preferred $D_{10,50\ and\ 90}$ values are specified below.

The determination of $D_{10}$, $D_{50}$, and $D_{90}$ is accurately determined using instruments available in the art. A Malvern Instruments, Ltd. (Malvern, U.K) model Mastersizer® S, version 2.18 is suitably equipped by the manufacturer to analyze the particle volume distribution and analyze the cumulative vol. % fraction ulm sizes at $D_{10}$, $D_{50}$, and $D_{90}$ The particle fraction data is inputted to conventional regression analysis techniques imbedded in typical statistical software such as Excel® for determination of $R^2$.

Figure 2:
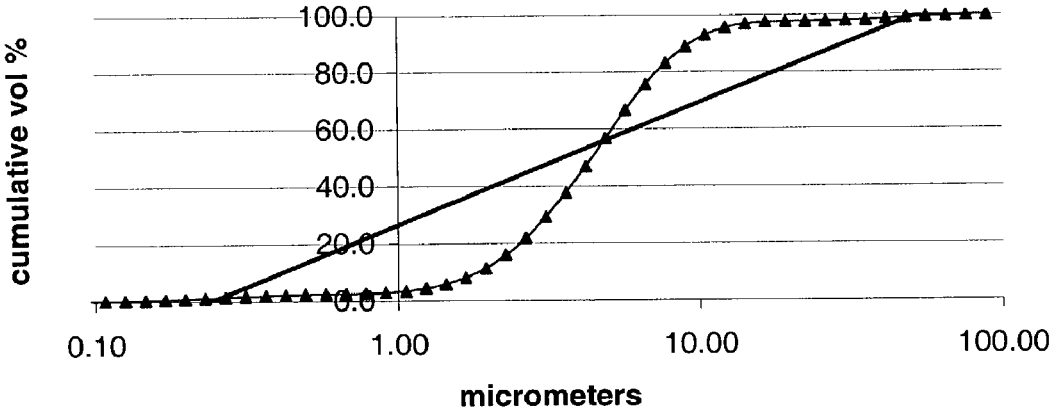
FIG. 2 is a log normal regression plot by Excel® of cumulative vol. % vs. log normal particle size (μm) for prior art carbonyl iron particles taken from the data in TABLE 1 below as measured using a Malvern Instruments, Ltd, Mastersizer® S, Version 2.18.

With reference to FIG. 2, this is a plot of log normal particle size against cumulative vol. % from the data in TABLE 1 using a Malvern Mastercizer® S for Control 1-carbonyl iron particles, R-2430, ex. ISP Corp.

TABLE 1

Control 1

ID" Control 1: carbonyl Iron (grade 2430)

| | | |
|---|---|---|
| Range: 300RF mm | Beam: 2.40 mm Sampler: MS1 | Obs[1]: 28.5% |
| Presentation: 3_IP&PAO | Analysis: Polydisperse | Residual: 0.393% |
| Modifications: None | Density = 1.000 g/cm^3 | S.S.A. = 2.3413 m^2/g |
| Conc. = 0.0106% Vol | D[4, 3] = 5.83 um | D[3, 2] = 2.56 um |
| Distribution: Volume | D(v, 0.5) = 4.66 um | D(v, 0.9) = 10.3 um |
| D(v, 0.1) = 1.95 um | Uniformity = 7.016E−01 | |
| Span = 1.694E+00 | | |

| Size (um) | Cum. Vol. % | Size (um) | Cum. Vol. % | Size (um) | Cum. Vol. % | Size (um) | Cum. Vol. % |
|---|---|---|---|---|---|---|---|
| 0.06 | 0.0 | 0.36 | 1.9 | 2.28 | 16.0 | 16.57 | 97.5 |
| 0.07 | 0.1 | 0.42 | 2.2 | 2.65 | 21.9 | 19.31 | 97.7 |
| 0.08 | 0.1 | 0.49 | 2.4 | 3.09 | 29.2 | 22.49 | 97.7 |
| 0.09 | 0.2 | 0.58 | 2.5 | 3.60 | 37.7 | 26.20 | 97.8 |
| 0.11 | 0.2 | 0.67 | 2.6 | 4.19 | 46.9 | 30.53 | 98.0 |
| 0.13 | 0.3 | 0.78 | 2.7 | 4.88 | 56.7 | 35.56 | 98.3 |
| 0.15 | 0.5 | 0.91 | 2.9 | 5.69 | 66.6 | 41.43 | 98.7 |
| 0.17 | 0.6 | 1.06 | 3.4 | 6.63 | 75.6 | 48.27 | 99.1 |
| 0.20 | 0.9 | 1.24 | 4.3 | 7.72 | 83.2 | 56.23 | 99.4 |
| 0.23 | 1.1 | 1.44 | 5.8 | 9.00 | 89.0 | 65.51 | 99.7 |
| 0.27 | 1.4 | 1.68 | 8.1 | 10.48 | 93.0 | 76.32 | 99.9 |
| 0.31 | 1.7 | 1.95 | 11.4 | 12.21 | 95.6 | 88.91 | 100.0 |
| | | | | 14.22 | 96.9 | 103.58 | 100.0 |

Figure 3:
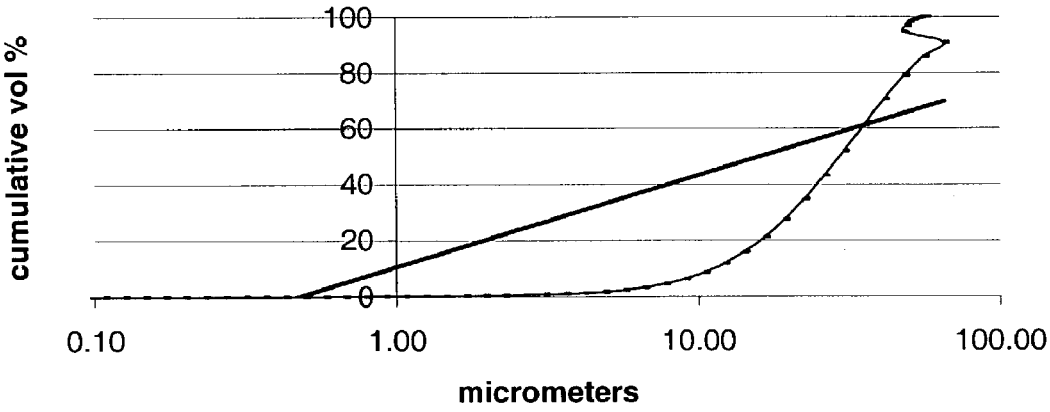
FIG. 3 is a log normal regression plot by Excel® of cumulative vol. % vs. log normal particle size (μm) for conventional atomized particles taken from the data in TABLE 2 below, as measured using a Malvern Instruments, Ltd, Mastersizer® S, Version 2.18.

With reference to FIG. 3, this is plot of log normal particle size against cumulative vol. % from the data in TABLE 2 using a Malvern Mastercizer® S for atomized particles FPI (−325 mesh) ex. Hoeganes.

TABLE 2

Control 2

ID: Control 2 Atomet Grade FPI (−325 mesh)

| | | |
|---|---|---|
| Range: 300RF mm | Beam: 2.40 mm Sampler: MS1 | Obs[1]: 30.40% |
| Presentation: 3_IP&PAO | Analysis: Polydisperse | Residual: 0.361% |
| Modifications: None | Density = 1.000 g/cm^3 | S.S.A. = 0.3028 m^2/g |
| Conc. = 0.0934% Vol | D[4, 3] = 35.27 um | D[3, 2] = 19.82 um |
| Distribution: Volume | D(v, 0.5) = 29.60 um | D(v, 0.9) = 63.64 um |
| D(v, 0.1) = 11.26 um | Uniformity = 5.583E−01 | |
| Span = 1.770E+00 | | |

| Size (um) | Cum. Vol. % | Size (um) | Cum. Vol. % | Size (um) | Cum. Vol. % | Size (um) | Cum. Vol. % |
|---|---|---|---|---|---|---|---|
| 0.06 | 0.0 | 0.36 | 0.0 | 2.28 | 0.6 | 16.57 | 21.1 |
| 0.07 | 0.0 | 0.42 | 0.0 | 2.65 | 0.7 | 19.31 | 27.3 |
| 0.08 | 0.0 | 0.49 | 0.0 | 3.09 | 0.9 | 22.49 | 34.7 |
| 0.09 | 0.0 | 0.58 | 0.0 | 3.60 | 1.1 | 26.20 | 43.0 |
| 0.11 | 0.0 | 0.67 | 0.1 | 4.19 | 1.4 | 30.53 | 51.9 |
| 0.13 | 0.0 | 0.78 | 0.1 | 4.88 | 1.8 | 35.56 | 61.1 |
| 0.15 | 0.0 | 0.91 | 0.2 | 5.69 | 2.4 | 41.43 | 70.5 |
| 0.17 | 0.0 | 1.06 | 0.2 | 6.63 | 3.3 | 48.27 | 78.8 |
| 0.20 | 0.0 | 1.24 | 0.3 | 7.72 | 4.6 | 56.23 | 85.7 |
| 0.23 | 0.0 | 1.44 | 0.3 | 9.00 | 6.3 | 65.51 | 90.9 |
| 0.27 | 0.0 | 1.68 | 0.4 | 10.48 | 8.6 | 76.32 | 94.5 |
| 0.31 | 0.0 | 1.95 | 0.5 | 12.21 | 11.8 | 88.91 | 96.8 |
| | | | | 14.22 | 15.9 | 103.58 | 98.1 |
| | | | | | | 120.67 | 98.8 |
| | | | | | | 140.58 | 99.1 |
| | | | | | | 163.77 | 99.4 |
| | | | | | | 190.80 | 99.6 |
| | | | | | | 222.28 | 99.8 |
| | | | | | | 258.95 | 99.9 |
| | | | | | | 301.68 | 100.0 |

Figure 4:
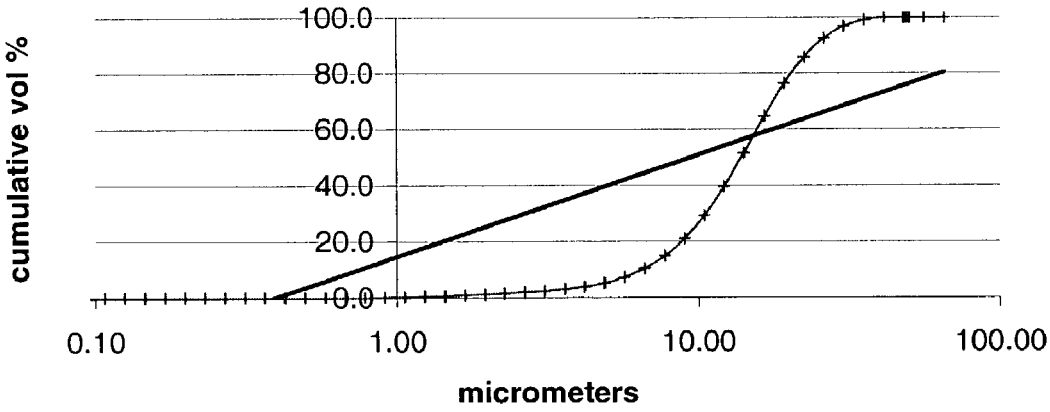
FIG. 4 is a log normal regression plot by Excel® of cumulative vol. % vs. log normal particle size (μm) for conventional atomized iron particles taken from the data in TABLE 3 below as measured using a Malvern Instruments, Ltd, Mastersizer® S, Version 2.18.

With reference to FIG. 4, this is a plot of log normal particle size against cumulative vol. % from the data in TABLE 3 using a Malvern Mastercizer® S for atomized particles of Control 3, FPI Grade II (2), ex. Hoeganes.

TABLE 3

Control 3

ID" Control 3: FPI - Grade 2

| | | |
|---|---|---|
| Range: 300RF mm | Beam: 2.40 mm Sampler: MS1 | Obs[1]: 24.7% |
| Presentation: 3_IP&PAO | Analysis: Polydisperse | Residual: 0.491% |
| Modifications: None | Density = 1.000 g/cm^3 | S.S.A. = 2.3413 m^2/g |
| Conc. = 0.0449% Vol | D[4, 3] = 17.31 um | D[3, 2] = 12.20 um |
| Distribution: Volume | D(v, 0.5) = 16.27 um | D(v, 0.9) = 28.61 um |
| D(v, 0.1) = 7.58 um | Uniformity = 4.023E−01 | |
| Span = 1.292E+00 | | |

| Size (um) | Cum. Vol. % | Size (um) | Cum. Vol. % | Size (um) | Cum. Vol. % | Size (um) | Cum. Vol. % |
|---|---|---|---|---|---|---|---|
| 0.06 | 0.0 | 0.36 | 0.0 | 2.28 | 1.2 | 16.57 | 51.5 |
| 0.07 | 0.0 | 0.42 | 0.0 | 2.65 | 1.6 | 19.31 | 64.5 |
| 0.08 | 0.0 | 0.49 | 0.0 | 3.09 | 2.0 | 22.49 | 76.3 |
| 0.09 | 0.0 | 0.58 | 0.0 | 3.60 | 2.4 | 26.20 | 85.8 |
| 0.11 | 0.0 | 0.67 | 0.0 | 4.19 | 3.0 | 30.53 | 92.5 |
| 0.13 | 0.0 | 0.78 | 0.0 | 4.88 | 3.9 | 35.56 | 96.8 |
| 0.15 | 0.0 | 0.91 | 0.0 | 5.69 | 5.3 | 41.43 | 99.1 |
| 0.17 | 0.0 | 1.06 | 0.1 | 6.63 | 7.3 | 48.27 | 100.0 |
| 0.20 | 0.0 | 1.24 | 0.2 | 7.72 | 10.4 | 56.23 | 100.0 |
| 0.23 | 0.0 | 1.44 | 0.4 | 9.00 | 14.9 | 65.51 | 100.0 |
| 0.27 | 0.0 | 1.68 | 0.6 | 10.48 | 21.1 | 76.32 | 100.0 |

TABLE 3-continued

| Control 3 | | | | | | | |
|---|---|---|---|---|---|---|---|
| 0.31 | 0.0 | 1.95 | 0.9 | 12.21 | 29.3 | 88.91 | 100.0 |
| | | | | 14.22 | 39.6 | 103.58 | 100.0 |
| | | | | | | 120.67 | 100.0 |

Figure 5:
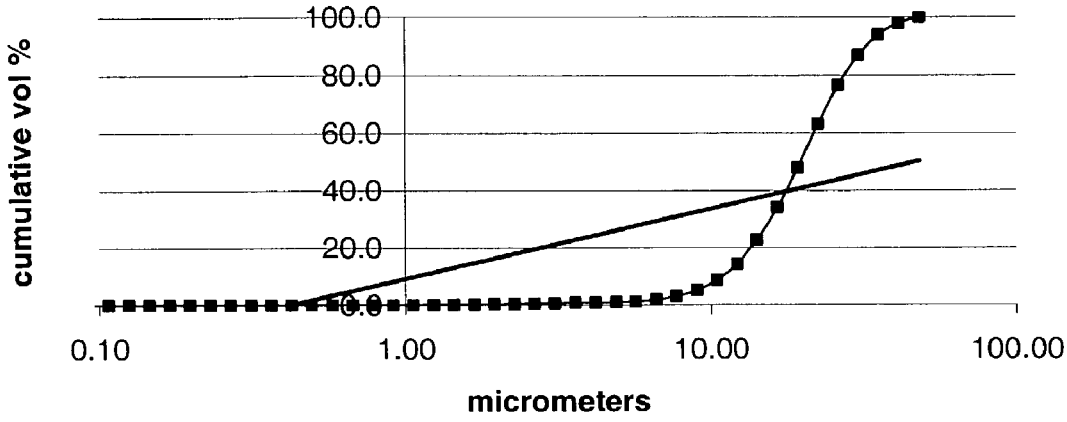
FIG. 5 is a log normal regression plot by Excel® of cumulative vol. % vs. log normal particle size (μm) for conventional atomized particles taken from the data in TABLE 4 below as measured using a Malvern Instruments, Ltd, Mastersizer® S, Version 2.18.

With reference to FIG. 5, this is plot of log normal particle size against cumulative vol. % from the data in TABLE 4 using a Malvern Mastercizer® S for atomized particles of Control 4, FPI Grade 11 GAF, ex. Hoeganes.

TABLE 4

Control 4

ID" Control 3: Hoeganes ® Grade II GAF

| | | |
|---|---|---|
| Range: 300RF mm | Beam: 2.40 mm Sampler: MS1 | Obs[1]: 24.7% |
| Presentation: 3_IP&PAO | Analysis: Polydisperse | Residual: 0.491% |
| Modifications: None | Density = 1.000 g/cm^3 | S.S.A. = 2.3413 m^2/g |
| Conc. 0.0449% Vol | D[4, 3] = 17.31 um | D[3, 2] = 12.20 um |
| Distribution: Volume | D(v, 0.5) = 19.0 um | D(v, 0.9) = 32.5 um |
| D(v, 0.1) = 10.2 um | Uniformity = 4.023E−01 | |
| Span = 1.292E+00 | | |

| Size (um) | Cum. Vol. % | Size (um) | Cum. Vol. % | Size (um) | Cum. Vol. % | Size (um) | Cum. Vol. % |
|---|---|---|---|---|---|---|---|
| 0.06 | 0.0 | 0.36 | 0.0 | 2.28 | 0.5 | 16.57 | 34.1 |
| 0.07 | 0.0 | 0.42 | 0.0 | 2.65 | 0.6 | 19.31 | 47.9 |
| 0.08 | 0.0 | 0.49 | 0.0 | 3.09 | 0.7 | 22.49 | 63.1 |
| 0.09 | 0.0 | 0.58 | 0.0 | 3.60 | 0.8 | 26.20 | 76.5 |
| 0.11 | 0.0 | 0.67 | 0.0 | 4.19 | 0.9 | 30.53 | 86.9 |
| 0.13 | 0.0 | 0.78 | 0.0 | 4.88 | 1.0 | 35.56 | 93.9 |
| 0.15 | 0.0 | 0.91 | 0.0 | 5.69 | 1.3 | 41.43 | 98.0 |
| 0.17 | 0.0 | 1.06 | 0.0 | 6.63 | 1.9 | 48.27 | 100.0 |
| 0.20 | 0.0 | 1.24 | 0.1 | 7.72 | 3.1 | 56.23 | 100.0 |
| 0.23 | 0.0 | 1.44 | 0.2 | 9.00 | 5.2 | 65.51 | 100.0 |
| 0.27 | 0.0 | 1.68 | 0.2 | 10.48 | 8.7 | 76.32 | 100.0 |
| 0.31 | 0.0 | 1.95 | 0.4 | 12.21 | 14.4 | 88.91 | 100.0 |
| | | | | 14.22 | 22.8 | 103.58 | 100.0 |
| | | | | | | 120.67 | 100.0 |

Figure 6:
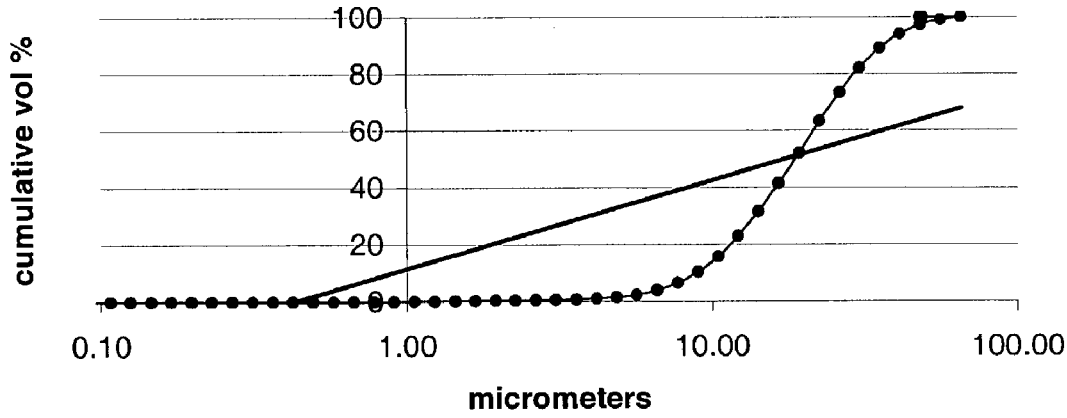
FIG. 6 a log normal regression plot by Excel® of cumulative vol. % vs. log normal particle size (μm) for conventional atomized particles taken from the data in TABLE 5 below as measured using a Malvern Instruments, Ltd, Mastersizer® S, Version 2.18

With reference to FIG. 6, this is a plot of log normal particle size against cumulative vol. % from the data in TABLE 5 using a Malvern Mastercizer® S for atomized particles of Control 5, Atomet® PD 3871, ex. Quebec Metal Powders.

TABLE 5

Control 5

ID" Control 5: Atomet ® PD 3871

| | | |
|---|---|---|
| Range: 300RF mm | Beam: 2.40 mm Sampler: MS1 | Obs[1]: 18.8% |
| Presentation: 3_IP&PAO | Analysis: Polydisperse | Residual: 0.338% |
| Modifications: None | Density = 1.000 g/cm^3 | S.S.A. = 0.4022 m^2/g |
| Conc. = 0.0406% Vol | D[4, 3] = 20.96 um | D[3, 2] = 14.92 um |
| Distribution: Volume | D(v, 0.5) = 18.73 um | D(v, 0.9) = 36.46 um |
| D(v, 0.1) = 8.87 um | Uniformity = 4.585E−01 | |
| Span = 1.473E+00 | | |

| Size (um) | Cum. Vol. % | Size (um) | Cum. Vol. % | Size (um) | Cum. Vol. % | Size (um) | Cum. Vol. % |
|---|---|---|---|---|---|---|---|
| 0.06 | 0.0 | 0.36 | 0.0 | 2.28 | 0.5 | 16.57 | 41.5 |
| 0.07 | 0.0 | 0.42 | 0.0 | 2.65 | 0.6 | 19.31 | 52.1 |
| 0.08 | 0.0 | 0.49 | 0.0 | 3.09 | 0.7 | 22.49 | 63.2 |
| 0.09 | 0.0 | 0.58 | 0.0 | 3.60 | 0.8 | 26.20 | 73.4 |

TABLE 5-continued

| Control 5 | | | | | | | |
|---|---|---|---|---|---|---|---|
| 0.11 | 0.0 | 0.67 | 0.0 | 4.19 | 1.1 | 30.53 | 82.1 |
| 0.13 | 0.0 | 0.78 | 0.0 | 4.88 | 1.5 | 35.56 | 89.0 |
| 0.15 | 0.0 | 0.91 | 0.0 | 5.69 | 2.4 | 41.43 | 94.0 |
| 0.17 | 0.0 | 1.06 | 0.1 | 6.63 | 4.0 | 48.27 | 97.3 |
| 0.20 | 0.0 | 1.24 | 0.2 | 7.72 | 6.5 | 56.23 | 99.1 |
| 0.23 | 0.0 | 1.44 | 0.2 | 9.00 | 10.4 | 65.51 | 100.0 |
| 0.27 | 0.0 | 1.68 | 0.3 | 10.48 | 15.9 | 76.32 | 100.0 |
| 0.31 | 0.0 | 1.95 | 0.4 | 12.21 | 23.0 | 88.91 | 100.0 |
| | | | | 14.22 | 31.7 | 103.58 | 100.0 |
| | | | | | | 120.67 | 100.0 |

Figure 7:
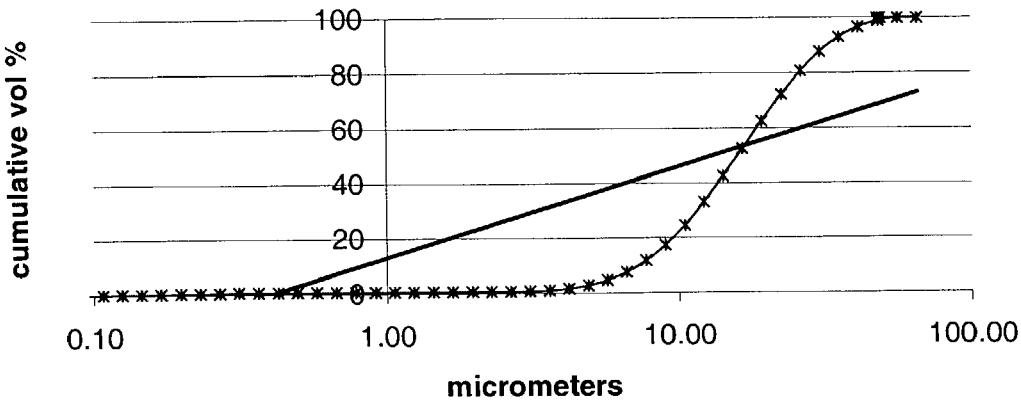
FIG. 7 is a log normal regression plot by Excel® of cumulative vol. % vs. log normal particle size (μm) for conventional atomized particles taken from the data in TABLE 6 below as measured using a Malvern Instruments, Ltd, Mastersizer® S, Version 2.18

With reference to FIG. 7, this is a plot of log normal particle size against cumulative vol. % from the data in TABLE 6 using a Malvern Mastercizer® S for atomized particles of Control 6, Atomet® PD 4155, ex. Quebec Metal Powders.

TABLE 6

Control 6

ID" Control 6: Atomet ® PD 4155

| | | |
|---|---|---|
| Range: 300RF mm | Beam: 2.40 mm Sampler: MS1 | Obs[1]: 24.6% |
| Presentation: 3_IP&PAO | Analysis: Polydisperse | Residual: 0.421% |
| Modifications: None | Density = 1.000 g/cm^3 | S.S.A. = 0.4022 m^2/g |
| Conc. = 0.0350% Vol | D[4, 3] = 21.10 um | D[3, 2] = 8.72 um |
| Distribution: Volume | D(v, 0.5) = 18.55 um | D(v, 0.9) = 37.78 um |
| D(v, 0.1) = 8.46 um | Uniformity = 4.907E−01 | |
| Span = 1.581E+00 | | |

| Size (um) | Cum. Vol. % | Size (um) | Cum. Vol. % | Size (um) | Cum. Vol. % | Size (um) | Cum. Vol. % |
|---|---|---|---|---|---|---|---|
| 0.06 | 0.02 | 0.36 | 0.7 | 2.28 | 0.5 | 16.57 | 52.5 |
| 0.07 | 0.1 | 0.42 | 0.7 | 2.65 | 0.7 | 19.31 | 62.4 |
| 0.08 | 0.1 | 0.49 | 0.7 | 3.09 | 0.8 | 22.49 | 72.2 |
| 0.09 | 0.1 | 0.58 | 0.7 | 3.60 | 1.1 | 26.20 | 80.6 |
| 0.11 | 0.2 | 0.67 | 0.7 | 4.19 | 1.7 | 30.53 | 87.6 |
| 0.13 | 0.2 | 0.78 | 0.7 | 4.88 | 2.8 | 35.56 | 92.9 |
| 0.15 | 0.3 | 0.91 | 0.7 | 5.69 | 4.7 | 41.43 | 96.5 |
| 0.17 | 0.4 | 1.06 | 0.7 | 6.63 | 7.5 | 48.27 | 98.8 |
| 0.20 | 0.5 | 1.24 | 0.7 | 7.72 | 11.7 | 56.23 | 99.9 |
| 0.23 | 0.6 | 1.44 | 0.7 | 9.00 | 17.4 | 65.51 | 99.9 |
| 0.27 | 0.6 | 1.68 | 0.7 | 10.48 | 24.6 | 76.32 | 99.9 |
| 0.31 | 0.7 | 1.95 | 0.7 | 12.21 | 33.1 | 88.91 | 99.9 |
| | | | | 14.22 | 42.5 | 103.58 | 99.9 |
| | | | | | | 120.67 | 99.9 |

Figure 8:
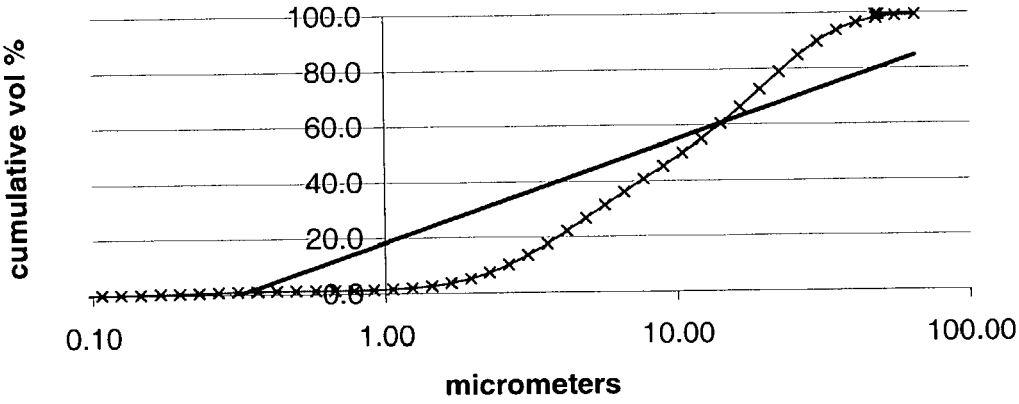
FIG. 8 is a log normal regression plot by Excel® of cumulative vol. % vs. log normal particle size (μm) for conventional atomized particles taken from the data in TABLE 7 below as measured using a Malvern Instruments, Ltd, Mastersizer® S, Version 2.18

With reference to FIG. 8, this is plot of log normal particle size against cumulative vol. % from the data in TABLE 7 using a Malvern Mastercizer® S for Control 7, a 50:50 wt. % mix of carbonyl iron 2430 and FPI Grade 11.

TABLE 7

Control 7

ID: Control 7 (50:50 mix Ctrl 1: Ctrl 4) (carbonyl Iron/FPI Grade 2)

| | | |
|---|---|---|
| Range: 300RF mm | Beam: 2.40 mm | Obs[1]: 26.8% |
| Presentation: 3_IP&PAO | Analysis: Polydisperse | Residual: 0.463% |
| Modifications: None | Density = 1.000 gm/cm^3 | S.S.A. = 1.3630 m^2/g |
| Conc. = 0.0174% vol | D[4, 3] = 14.88 | D[3, 2] = 4.40 um |
| Distribution: Volume | D(v, 0.5) = 10.49 | D(v, 0.9) = 30.77 |
| D(v, 0.1) = 2.63 | Uniformity = 9.433E−01 | |
| Span = 2.683E+00 | | |

TABLE 7-continued

| Control 7 | | | | | | | |
|---|---|---|---|---|---|---|---|
| Size (um) | Cum. Vol. % | Size (um) | Cum. Vol. % | Size (um) | Cum. Vol. % | Size (um) | Cum. Vol. % |
| 0.06 | 0.0 | 0.36 | 1.1 | 2.28 | 7.4 | 16.57 | 66.2 |
| 0.07 | 0.0 | 0.42 | 1.2 | 2.65 | 10.2 | 19.31 | 72.5 |
| 0.08 | 0.1 | 0.49 | 1.3 | 3.09 | 13.6 | 22.49 | 78.9 |
| 0.09 | 0.1 | 0.58 | 1.3 | 3.60 | 17.7 | 26.20 | 84.8 |
| 0.11 | 0.2 | 0.67 | 1.3 | 4.19 | 22.1 | 30.53 | 89.8 |
| 0.13 | 0.2 | 0.78 | 1.3 | 4.88 | 26.8 | 35.56 | 93.7 |
| 0.15 | 0.3 | 0.91 | 1.4 | 5.69 | 31.5 | 41.43 | 96.4 |
| 0.17 | 0.4 | 1.06 | 1.7 | 6.63 | 36.1 | 48.27 | 98.1 |
| 0.20 | 0.6 | 1.24 | 2.0 | 7.72 | 40.7 | 56.23 | 98.9 |
| 0.23 | 0.7 | 1.44 | 2.7 | 9.00 | 45.3 | 65.51 | 99.3 |
| 0.27 | 0.9 | 1.68 | 3.7 | 10.48 | 50.0 | 76.32 | 99.3 |
| 0.31 | 1.0 | 1.95 | 5.2 | 12.21 | 54.9 | 88.91 | 99.3 |
| | | | | 14.22 | 60.3 | 103.58 | 99.3 |
| | | | | | | 120.67 | 99.3 |

Figure 9:
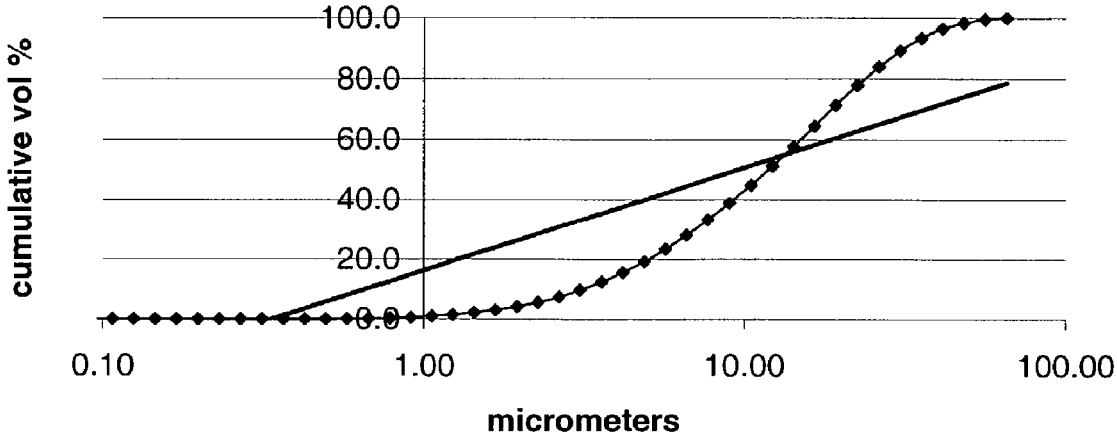
FIG. 9 is a log normal regression plot by Excel(®) of cumulative vol. % vs. log normal particle size (μm) for atomized particles of Example 1 taken from the data in TABLE 8 below as measured using a Malvern Instruments, Ltd, Mastersizer® S, Version 2.18

With reference to FIG. 9, a plot of log normal particle size against cumulative vol. % from data in TABLE 8 for atomized particles used in accordance with the invention.

TABLE 8

Example 1 according to the Invention

ID: Example 1 (Atmix PF20E)

| | | |
|---|---|---|
| Range: 300RF mm | Beam: 2.40 mm Sampler: MS1 | Obs[1]: 24.4% |
| Presentation: 3_IP&PAO | Analysis: Polydisperse | Residual: 0.644% |
| Modifications: None | Density = 1.000 g/cm^3 | S.S.A. = 0.8738 m^2/g |
| Conc. = 0.0237% Vol | D[4, 3] = 14.96 um | D[3, 2] = 6.78 um |
| Distribution: Volume | D(v, 0.5) = 11.89 um | D(v, 0.9) = 31.34 um |
| D(v, 0.1) = 3.14 um | Uniformity = 7.412E−01 | |
| Span = 2.371E+00 | | |

| Size (um) | Cum. Vol. In % | Size (um) | Cum. Vol. In % | Size (um) | Cum. Vol. In % | Size (um) | Cum. Vol. In % |
|---|---|---|---|---|---|---|---|
| 0.06 | 0.00 | 0.36 | 0.00 | 2.28 | 5.7 | 16.57 | 64.4 |
| 0.07 | 0.00 | 0.42 | 0.00 | 2.65 | 7.5 | 19.31 | 71.3 |
| 0.08 | 0.00 | 0.49 | 0.00 | 3.09 | 9.7 | 22.49 | 77.9 |
| 0.09 | 0.00 | 0.58 | 0.1 | 3.60 | 12.4 | 26.20 | 84.0 |
| 0.11 | 0.00 | 0.67 | 0.2 | 4.19 | 15.6 | 30.53 | 89.2 |
| 0.13 | 0.00 | 0.78 | 0.4 | 4.88 | 19.2 | 35.56 | 93.4 |
| 0.15 | 0.00 | 0.91 | 0.7 | 5.69 | 23.4 | 41.43 | 96.4 |
| 0.17 | 0.00 | 1.06 | 1.0 | 6.63 | 28.1 | 48.27 | 98.4 |
| 0.20 | 0.00 | 1.24 | 1.5 | 7.72 | 33.3 | 56.23 | 99.5 |
| 0.23 | 0.00 | 1.44 | 2.2 | 9.00 | 38.9 | 65.51 | 100.0 |
| 0.27 | 0.00 | 1.68 | 3.1 | 10.48 | 44.8 | 76.32 | |
| 0.31 | 0.00 | 1.95 | 4.2 | 12.21 | 51.1 | 88.91 | |
| | | | | 14.22 | 57.6 | >88.91 | |

Figure 1:
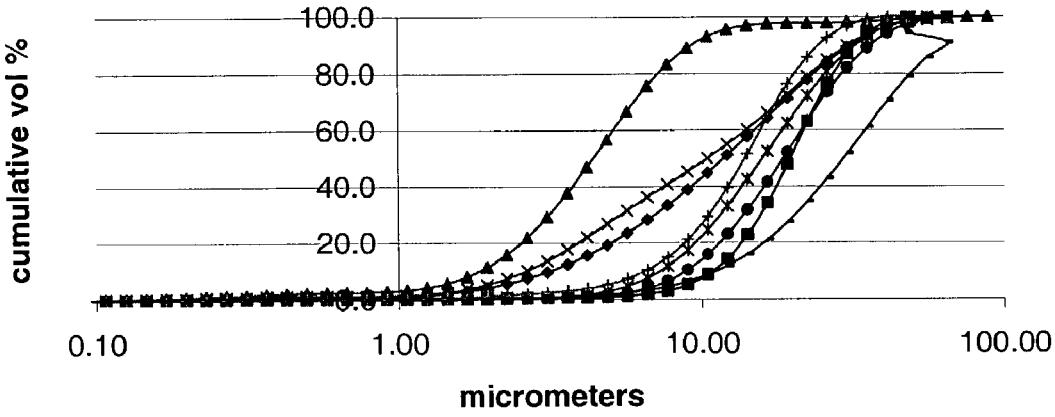
FIG. 1 is a log normal regression plot by Excel® of cumulative vol. % vs. log normal particle size (μm) for iron particles taken from the data in TABLES 1–8 below as measured using a Malvern Instruments, Ltd, Mastersizer® S, Version 2.18.

Reference is made to FIG. 1, which includes the log normal plots of the data taken from each of the above examples to visually illustrate the conformity of carbonyl iron (C-1) to the other examples of atomized particles and mixture (Control 7). For each example analyzed for volume % distribution, the cumulative volume fraction data in relation to log normal particle size (μm) was inputted to regression analysis software from Microsoft® Excel, and a least squares regression function calculated. The $R^2$ values obtained for the examples characterizes the degree of conformity to a log normal distribution. The $R^2_{values}$ are arranged in descending order below.

| Particle type | $R^2$ |
|---|---|
| FIG. 2 Control 1 carbonyl iron | 0.86 |
| FIG. 8 Control 7 50:50 mix (U.S. Pat. No. 6,027,664) | 0.82 |
| FIG. 9 Example 1 Atomized single process | 0.77 |
| FIG. 4 Control 3 Prior art Atomized single process | 0.70 |
| FIG. 7 Control 6 Prior art Atomized single process | 0.66 |
| FIG. 3 Control 2 Prior art Atomized single process | 0.65 |
| FIG. 6 Control 5 Prior art Atomized single process | 0.63 |
| FIG. 5 Control 4 Prior art Atomized single process | 0.63 |

In accordance with the present invention the MR fluid incorporates a single process yield atomized particle population exhibiting a $R^2$ of greater than or equal to 0.77.

A method to make the particles of a "single process yield" (non mixtures as distinguished from blends of more than one lot, or process stream) having an $R^2$ of greater than or equal to 0.77 and $D_{10}$ of 2 μm up to and including a $D_{10}$ of 5 μm; a $D_{50}$ of 8 μm up to and including a $D_{50}$ of 15 μm; and a $D_{90}$ of 25 μm up to and including a $D_{90}$ of 40 μm is disclosed in WO 99/11407. The process is a hybrid gas-water atomization process whereby gas (e.g. air) flows into an entry of a tapered inlet nozzle as a laminar flow and flows out of the nozzle at near to speed of sound in the vicinity of the exit of the nozzle. The nozzle assembly contains orifice in a center thereof, a slit surrounding a lower side of the nozzle for injection of water in a shape of an inverse cone, and an ejector tube which is perpendicular to the lower face of the nozzle and coaxial to the orifice. The shape of the nozzle is constructed so that gas is drawn in laminar flow from an upper side of the orifice, the velocity of the gas increases as it passes the narrowing area of the orifice to a speed near or equal to the velocity of sound as gas exits the orifice. The nozzle apparatus contains a baffle plate/annular ring at the exit of the orifice having an aperture with a smaller diameter than an aperture of the exit of the orifice. The pressure of the gas is decreased from the entry to the exit along the nozzle, is raised upon departure from the exit of the nozzle, and the raised pressure of the gas is decreased until reaching to a point of convergence of a liquid jet of the inverse cone shape flow. The gas emerging from the orifice expands abruptly and collides against a wall of liquid jet, and generates expansion and compression waves by reflections of the collided gas. By repeated reflections on the wall of liquid, expansion and compression waves induce splitting action to the flow of molten metal as the atomizing phenomenon takes place. A commercial product providing the single process yield and above-specified $D_{10}$ , $D_{50}$, and $D_{90}$ is sold by Atmix Corp, under the PF-20 E designation. U.S. Pat. No. 6,254,661 is hereby incorporated by reference as if fully described herein.

The atomized metallic compositions prepared in the above hybrid method for the MR fluid particle component herein can be iron alone or iron optionally in combination with alloying levels of aluminum, silicon, cobalt, nickel, vanadium, molybdenum, chromium, tungsten, boron, manganese and/or copper and the like, e.g., iron : cobalt and iron:nickel alloys ranging from about 30:70 W/W to 95:5 W/W, and preferably from about 50:50 to 85:15. Exemplary iron-nickel alloys have an iron-nickel ratio ranging from about 90:10 to 99:1, and preferably from about 94:6 to 97:3. Alloys may contain small amounts up to 3 wt. % of other elements, such as vanadium, chromium, etc., in order to improve the ductility and mechanical properties of the alloys. Exemplary particles also comprise iron oxide, and/or iron nitride, and/or iron carbide. Iron oxide includes all known pure iron oxides, such as $Fe_2O_3$ and $Fe_3O_4$, as well as those containing small amounts of other elements, such as manganese, zinc or barium. Specific examples of iron oxide include ferrites and magnetites. Preferably, the magnetic-responsive particles used will have less than about 0.01% carbon. In an especially preferred embodiment, the magnetic-responsive particles will contain 97% to 99% iron, and less than about 1% oxygen and nitrogen.

Of the total fluid, the particle component represents from about 5 to about 50 volume percent, and preferably from about 15 to 40 vol. % of the total volume of magnetorheological fluid is made up of the particle component. The volume % of particle component is selected within the specified range depending on the desired magnetic yield stress desired and the viscosity of the MR fluid. In terms of weight % corresponding to the above range of volume fraction, there is 30 to 89 wt. %, preferably about 59 to 85 wt. % when the carrier fluid and particles of the magnetorheological fluid have a specific gravity of about 0.80 and 7.8, respectively.

The magnetorheological compositions of the invention are dispersed in a carrier fluid to provide a magnetorheological fluid composition. The carrier component is present in an amount of about 50 to about 95 volume percent of said magnetorheological fluid. The volume % of particle component in magnetorheological fluid embodiments is preselected depending upon the designed-in yield stress level, off-state viscosity, and other fluid or device design factors which are known by the skilled person and beyond the scope of this disclosure. The carrier component forms the continuous phase of the magnetorheological fluid. The carrier fluid used to form a magnetorheological fluid from the magnetorheological compositions of the invention may be any of the vehicles or carrier fluids known for use with magnetorheological fluids. If the magnetorheological fluid is to be an aqueous fluid, one of skill in the art will understand which of the additives disclosed herein are suitable for such systems. Aqueous systems are described, for example, in U.S. Pat. No. 5,670,077, incorporated herein by reference in its entirety. Where a water-based system is used, the magnetorheological fluid formed may optionally contain one or more of an appropriate thixotropic agent, an anti-freeze component or a rust-inhibiting agent, and the like conventional optional additives.

In the preferred embodiment, the carrier fluid is an organic fluid. Suitable carrier fluids which may be used include natural fatty oils, mineral oils, polyphenylethers, dibasic acid esters, neopentylpolyol esters, phosphate esters, synthetic cycloparaffins and synthetic poly α-olefins, unsaturated hydrocarbon oils, monobasic acid esters, glycol esters and ethers, silicate esters, silicone oils, silicone copolymers, synthetic hydrocarbons, perfluorinated polyethers and esters and halogenated hydrocarbons, and mixtures or blends thereof. Hydrocarbons, such as mineral oils, paraffins, cycloparaffins (also known as naphthenic oils) and synthetic hydrocarbons are the preferred classes of carrier fluids. The synthetic hydrocarbon oils include those oils derived from oligomerization of olefins such as polybutenes and oils derived from high alpha olefins of from 8 to 20 carbon atoms by acid catalyzed dimerization and by oligomerization using trialuminum alkyls as catalysts. Poly-α-olefin oils are particularly preferred carrier fluids. Carrier fluids appropriate to the present invention may be prepared by methods well known in the art and many are commercially available, such as Durasyn PAO and Chevron Synfluid PAO. Preferred PAO fluids exhibit a viscosity of from 1 to 50 centistokes, at 100° C., more preferably 1 to 10 centistokes.

The magnetorheological fluid may optionally include other components such as a thixotropic agent or viscosity modifier, dispersant or surfactant, antioxidant, corrosion inhibitor, and one or more lubricants. Such optional components are known to those of skill in the art. For example, dispersants include carboxylate soaps such as lithium stearate, lithium hydroxy stearate, calcium stearate, aluminum stearate, ferrous oleate, ferrous naphthenate, zinc stearate, aluminum tristearate and distearate, sodium stearate, strontium stearate and mixtures thereof.

Examples optional additives that provide antioxidant function include zinc dithiophosphates, hindered phenols, aromatic amines, and sulfurized phenols. Examples of lubricants include organic fatty acids and amides, lard oil, and high molecular weight organophosphorus compounds, phosphoric acid esters. Example synthetic viscosity modifiers include polymers and copolymers of olefins, methacrylates, dienes or alkylated styrenes. In addition, other optional additives providing a steric stabilizing function include fluoroaliphatic polymeric esters, and compounds providing chemical coupling include organotitanate, -aluminates, -silicone, and -zirconates coupling agents.

One of skill in the art can readily select optional additive components as desired in a particular formulation. The amount of optional components typically each can range from about 0.25 to about 12 volume percent, based on the total volume of the magnetorheological fluid. Preferably, the optional ingredients each will be present in the range of about 0.5 to about 7.5 volume percent based on the total volume of the magnetorheological fluid.

An optional, but preferred thixotropic agent included in the MR fluid is any such agent providing thixotropic rheology. The thixotropic agent selected is in light of a selected carrier fluid. If the magnetorheological fluid is formed with a carrier fluid which is an organic fluid, a thixotropic agent compatible with such a system may be selected. Thixotropic agents useful for such organic fluid systems are described in U.S. Pat. No. 5,645,752, incorporated herein by reference in its entirety. Preferably, oil-soluble, metal carboxylates, and the like collectively referred to as soaps, such as the carboxylate soaps listed above are employed. The carrier can comprise water alone, or water in mixture with water-miscible solvents like $C_1$–$C_5$ alcohols, glycols, glycerols, and ether or ester derivatives of glycols. . The thixotropic agents and colloidal additives, if utilized, are typically employed in an amount ranging from about 0.1 to 5.0 and preferably from about 0.5 to 3.0 percent by volume of the magnetorheological fluid. Examples of preferred thixotropic agents include soaps, colloidal sized silica particles and similar silicon-containing particles like fumed silica, fumed alumina, aluminosilicates, magnesium silicates, and naturally occurring clay, modified by treatment with hydrophobic organic compounds (organoclays).

The off-state viscosity of the magnetorheological fluid containing the magnetorheological compositions of the present invention is dependent upon the volume of particle component and type of carrier fluid, and thixotropic agent utilized, if any. One ordinarily skilled in the art can readily determine a desired viscosity according to the description herein provided.

The magnetorheological fluid of the invention may also contain other optional additives such as dyes or pigments, abrasive particles, lubricants, antioxidants, pH shifters, salts, deacidifiers and/or corrosion inhibitors. These optional additives may be in the form of dispersions, suspensions, or materials that are soluble in the carrier vehicle. Preferred embodiments contain organoclay thixotropic agent such as bentonites. Bentonite clays form networks in the continuous ohase carrier fluid, which are easily disrupted by the application of shear, and which reform when the shear is removed. Bentonite clay material is organo-modified by treating with a hydrophobic organic material. The materials referred to as bentonite are sometimes mentioned interchangeably with the terms smectite and montmorillonite. Montmorillonite clay typically constitutes a large portion of bentonite clays. Montmorillonite clay contains a large fraction of aluminum silicate. Hectorite clay contains a large fraction of magnesium silicate. Commercially available organomodified clays include, for example, Claytone AF from Southern Clay Products and the Bentone®, Baragel®, and Nykon® families of organoclays from RHEOX. Other suitable clays include those disclosed in U.S. Pat. No. 5,634,969 to Cody et al. A preferred organoclay is Claytone EM.

The organoclays are used in concentrations of between about 0.1 to 12% by wt., preferably from 0.3 to 5.0 wt. %, based on the weight of the MR fluid composition. In a preferred embodiment the sole thixotropic agent present is bentonite, excluding other types of thickeners.

Preferred embodiments contain a friction reducing additive such as, colloidal sized silica particles, organomolybdenum, molybdenum disulfide. In other preferred embodiments, there is also included an extreme pressure additive. Extreme pressure additives are known in the art of lubricants and include organophosphorous compounds, phosphonate compounds, phosphonite, phosphate, phosphinate, phosphinite, phosphite and known derivates like their amide or imide derivatives, thiophosphorus compounds and thiocarbamates. Preferred organophosphorous extreme pressure additives have structure represented by the formula:

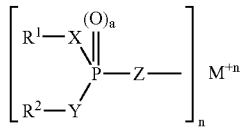

wherein $R^1$ and $R^2$ are each independently hydrogen, an amino group, or an alkyl group having 1 to 22 carbon atoms; X, Y and Z are each independently —$CH_2$—, a nitrogen heteroatom or an oxygen heteroatom, provided that at least one of X, Y or Z is an oxygen heteroatom; a is 0 or 1; and n is the valence of M; provided that if X, Y and Z are each an oxygen heteroatom, M is a salt moiety formed from an amine of the formula B:

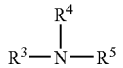

wherein $R^3$, $R^4$ and $R^5$ are each independently hydrogen or aliphatic groups having 1 to 18 carbon atoms; and if at least one of X, Y or Z is not an oxygen heteroatom, M is selected from the group consisting of a metallic ion, a non-metallic moiety and a divalent moiety; provided that if Z is —$CH_2$—, M is a divalent moiety and if Z is a nitrogen heteroatom, M is not an amine of formula B.

$R^1$ , $R^2$, $R^3$, $R^4$ and $R^5$ may be straight chain or branched chain alkyl groups. Examples of such groups include methyl, ethyl, propyl, isopropyl, tert-butyl, pentyl, dodecyl, decyl, hexadecyl, nonyl, octadecyl, 2-methyl dodecyl, 2-ethyl hexyl, 2-methyl pentyl, 2-ethyl octyl, 2-methyl octyl and 2-methyl hexyl. Illustrative amino groups for $R_1$ and $R_2$ include butylamine, nonylamine, hexadecylamine and decylamine and the amine shown in formula B above.

If at least one of X, Y or Z is not an oxygen heteroatom, M can be a metal ion such as molybdenum, tin, antimony, lead, bismuth, nickel, iron, zinc, silver, cadmium or lead or the carbides, oxides, sulfides or oxysulfides thereof. M can also be a non-metallic moiety such as hydrogen, a sulfur-containing group, alkyl, alkylaryl, arylalkyl, hydroxyalkyl, an oxy-containing group, amido or an amine. In general, any alkyl group should be suitable, but alkyls having from 2 to 20, preferably 3 to 16, carbon atoms are preferred. The alkyls could be straight chain or branched. Illustrative alkyl groups include methyl, ethyl, propyl, isopropyl, tert-butyl, pentyl, 2-ethylhexyl, dodecyl, decyl, hexadecyl and octadecyl. In general, any aryl groups should be suitable. Illustrative aryl groups include phenyl, benzylidene, benzoyl and naphthyl. In general, any amido-containing groups should be suitable. Illustrative amido groups include butynoamido, decynoamido, pentylamido and hexamido. In general, any amino groups should be suitable. Illustrative amino groups include butylamine, nonylamine, hexadecylamine and decylamine and the amine shown in formula B above. In general, any alkylaryl or arylalkyl groups should be suitable. Illustrative alkylaryl or arylalkyls include benzyl, phenylethyl, phenylpropyl, and alkyl-substituted phenyl alcohol. In general, any oxy-containing groups should be suitable, but alkoxy groups having from 2 to 20, preferably 3 to 12, carbon atoms are preferred. Illustrative alkoxy groups include methoxy, ethoxy, propoxy, butoxy and heptoxy. It should be recognized that if M is a metallic ion or a non-metallic moiety, Z cannot be —$CH_2$ —. M also can be a divalent group that links together two or more phosphorus-containing units to form a dimer, oligomer or polymer.

Suitable divalent groups include alkylene groups. In general, any alkylene groups should be suitable, but those having from 1 to 16, preferably 1 to 8, carbon atoms are preferred. Illustrative alkylene groups include methylene and propylene. It should be recognized that if Z is —CH2—, M must be a divalent moiety such as an alkylene group. A particularly preferred alkyl amine phosphate is a $C_{12-14}$-alkylamine salt of tert-octylphosphates commercially available from R.T. Vanderbilt Inc. wherein $R_1$ and $R_2$ are tert-octyl, subscript a is 1 and $R_3$ , $R_4$ and $R_5$ are $C_{12-14}$ alkyl groups.

Representative thiophosphorus extreme pressure additives have a structure represented by formula A:

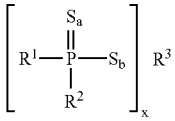

wherein $R^1$ and $R^2$ each individually have a structure represented by:

$$Y—((C)(R^4)(R^5))_n—(O)_w—$$

wherein Y is hydrogen or a functional group-containing moiety such as an amino, amido, imido, carboxyl, hydroxyl, carbonyl, oxo or aryl; n is an integer from 2 to 17 such that $C(R^4)(R^5)$ is a divalent group having a structure such as a straight-chained aliphatic, branched aliphatic, heterocyclic, or aromatic ring; $R^4$ and $R^5$ can each individually be hydrogen, alkyl or alkoxy; and w is 0 or 1.

A preferred thiocarbamate extreme pressure additives has a structure represented by formula B':

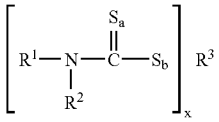

wherein $R^1$ and $R^2$ each individually have a structure represented by:

$$Y—((C)(R^4)(R^5))_n—$$

wherein Y is hydrogen or a functional group—containing moiety such as an amino, amido, imido, carboxyl, hydroxyl, carbonyl, oxo or aryl; n is an integer from 2 to 17 such that $C(R_4)(R_5)$ is a divalent group having a structure such as a straight-chained aliphatic, branched aliphatic, heterocyclic, or aromatic ring; and $R^4$ and $R^5$ can each individually be hydrogen, alkyl or alkoxy. $R^3$ of formula A or B' is a metal ion such as molybdenum, tin, antimony, lead, bismuth, nickel, iron, zinc, silver, cadmium or lead, and the like, or a nonmetallic moiety such as hydrogen, a sulfur-containing group, alkyl, alkylaryl, arylalkyl, hydroxyalkyl, an oxy-containing group, amido or an amine. Subscripts a and b of formula A or B' are each individually 0 or 1, provided a+b is at least equal to 1 and x of formula A or B' is an integer from 1 to 5 depending upon the valence number of $R^3$.

Useful organomolybdenum compounds are described in U.S. Pat. No. 4,889,647 and U.S. Pat. No. 5,412,130, both incorporated herein by reference. A suitable organomolybdenum complex is prepared by reacting a fatty oil, diethanolamine and a molybdenum source. A suitable heterocyclic organomolybdate is prepared by reacting diol, diamino-thiol-alcohol and amino-alcohol compounds with a molybdenum source in the presence of a phase transfer agent. Other suitable organomolybdenums are described in U.S. Pat. No. 5,137,647 incorporated herein by reference, such as organomolybdenum prepared by reacting an amine-amide with a molybdenum source. Molybdenum thiadiazoles are preferred molybdenum compounds and are described in U.S. Pat. No. 5,627,146 incorporated herein by reference. Commercially available molybdenum thiadiazoles are available from R.T. Vanderbilt Company under the trademark Molyvan®822 and 2000 designations. Another example compound is a molybdenum hexacarbonyl dixanthogen; an organomolybdenum prepared by reacting a hydrocarbyl substituted hydroxy alkylated amine with a molybdenum source as disclosed in U.S. Pat. No. 4,164,473; and alkyl esters of molybdic acid as disclosed in U.S. Pat. No. 2,805,997. Preferred organomolybdenums are prepared according to U.S. Pat. No. 4,889,647 and U.S. Pat. No. 5,412,130 and are commercially available from R.T. Vanderbilt Inc. under the trademark Molyvan® 855.

When employing an organomolybdenum compound, these are available in a liquid state at ambient room temperature, and can be directly introduced in effective usage levels ranging from 0.1 to 12%, preferably 0.25 to 10, volume percent, based on the total volume of the magnetorheological fluid.

The magnetorheological fluids of the present invention can be prepared by initially mixing the ingredients together by hand (low shear) with a spatula or the like and then subsequently more thoroughly mixing (high shear) with a homogenizer, mechanical mixer or shaker, or dispersing with an appropriate milling device such as a ball mill, sand mill, attritor mill, paint mill, colloid mill or the like.

The testing of various application specific devices, such as dampers, mounts, and clutches, that utilize either the magnetorheological materials of the present invention or other magnetorheological materials, is a second method of evaluating the mechanical performance of these materials. The controllable fluid-containing device is simply placed in line with a mechanical actuator and operated with a specified displacement and amplitude and frequency. A magnetic field is appropriately applied to the device and the force output determined from the resulting extension/compression waveforms plotted as a function of time. The methodology utilized to test dampers, mounts, and clutches is well known to those skills in the art of vibration control.

The magnetorheological fluid compositions described herein are readily adapted for use in a number of linear or rotary controllable devices, including brakes, pistons, clutches, and dampers. Examples of dampers which include magnetorheological fluids are disclosed in U.S. Pat. Nos. 5,390,121 and 5,277,281 incorporated herein by reference. A linear controllable apparatus for variably damping motion employing the magnetorheological fluid according to the present invention comprises the following elements:

a) a housing for containing a volume of magnetorheological fluid;

b) a piston adapted for movement within the fluid-containing housing, where the piston is made of a ferrous metal, incorporating therein a number of windings of an electrically conductive wire defining a coil which produces magnetic flux in and around the piston, and c) valve means having a working gap associated with the housing and the piston for controlling movement of the magnetorheological fluid.

Other known devices readily adapted to contain the MR fluid herein are fluid valves, composite structures and structural elements, shock absorbers, haptic devices, exercise equipment, electric switches, prosthetic devices including rapidly setting casts, elastomeric mounts, vibration mounts and other similar devices constructed to contain an excess of the amount of instant magnetorheological fluid required to occupy the working gap via a reservoir of magnetorheological fluid outside of the working gap from which particles can migrate into the working gap. In the typical example practices of the present invention, a first portion of the magnetorheological fluid is positioned in working gap while a second portion of the magnetorheological fluid is positioned outside the working gap, but in fluid communication with the magnetorheological fluid in the working gap, i.e., in fluid containment compartment. Upon polarization of the particles in the magnetorheological fluid by application of an external field, particles from the second portion move into the working gap thus increasing the force output of the magnetorheological fluid device as a result of the increased particle concentration in the magnetorheological fluid in the working gap. During application of an external field, the particle volume concentration in the first portion of the magnetorheological fluid is greater than the static or off-state overall particle volume concentration. Static or off-state particle volume concentration means the average particle volume concentration exhibited by the combination of the magnetorheological fluid in the first portion and the controllable fluid in the second portion when a magnetic field is not being applied.

MR fluid comprising a carrier and magnetic-responsive particles obtained from a single atomization process stream that possess unique particle distribution by the fact that the particles are unclassified except for removal of a minute fraction representing less than 5%, more typically less than 2% by volume, and more preferably less than 1% by volume of waste including outsized, a single coarse screening such as through a 200 mesh, 170 mesh or 140 mesh sieve (74, 88, and 105 micrometer (micron). The term "unclassified" used herein is interpreted to mean no further classification except for this single coarse screening. The particle population of the single process stream is distinguished on the basis of cumulative volume fractions less than or equal to specified micrometer (micron) size. Instrumented analysis known in the art report cummulative volume percent less than or equal to a specified size at 10%, 50% and 90%, and are known as $D_{10}$, $D_{50}$, and $D_{90}$, respectively. The magnetically responsive particles of the MR fluid operating within the working gap are uniquely characterized by a $D_{10}$ of 2 μm up to and including a $D_{10}$ of 5 μm; a $D_{50}$ of 8 μm to a $D_{50}$ of 15 μm; and $D_{90}$ of 25 μm up to a $D_{90}$ of 40 μm. The particle population from a single atomization process stream is further distinguished by a least squares regression of cumulative particle size against the log normal cumulative fraction ($R^2$) of 0.77 and higher. The particle component in accordance with the invention exhibits a relatively slow dry powder flow rate as compared to particles of the prior art. The method for determining the relative powder flow rates of various particle types using a scintillation vial is as described below.

Example particles are described below for comparison purposes. In each example, the percentages given for each particle group of the particle mixtures are in terms of weight percent based on the total weight of the particle component.

Powder Flow Test 35 grams of metal powder are placed into a 20 ml scintillation vial. The vial is tapped several times to level and settle the powder. The vial is threaded to a tapered funnel having a 15 mm opening and 60° taper angle which is attached to a 6V vibrating motor adapted from a telephone paging device. The time recorded to empty the contents is recorded. Two to three repeats are made with fresh samples and an average is taken. Measurements of various grades of iron particles were made to compare the powder flow rates.

| | $D_{10}$ | $D_{50}$ | $D_{90}$ | $R^2$ | Type | Particles | Time to empty (Sec.) | Ave. Sec. |
|---|---|---|---|---|---|---|---|---|
| Ctrl. 1 | 1.95 | 4.66 | 10.3 | 0.86 | Carbonyl iron | R-2430[1] | 11, 11, 10 | 10.7 |
| Ctrl. 2 | 11.3 | 29.6 | 66.5 | 0.65 | Water Atom. | FPI (−325 mesh)[2] $D_{50}$ 30 □m | 8, 7.5, 6.5, 7 | 7 |
| Ctrl. 3 | 7.58 | 16.3 | 28.8 | 0.70 | Water Atom. | FPI Grade II (2)[2] | 8, 8, 7.5 | 8 |
| Ctrl. 4 | 10.2 | 19.0 | 32.5 | 0.49 | Water Atom. | FPI Grade 11 GAF | 4.5, 4.5, 5.5 | 4.8 |
| Ctrl. 5 | 8.88 | 18.9 | 37.3 | 0.63 | Water Atom. | Atomet PD3871[3] | 6.5, 7.5, 7.5 | 7 |
| Ctrl. 6 | 8.46 | 18.6 | 37.8 | 0.66 | Water Atom. | Atomet PD4155[3] | 11.5, 10.5, 10 | 10.7 |
| | | | | | | Mixtures Weight Ratio | | |
| | | | | | Water Atom: Carbonyl iron | FPI Grade 1 mix with Carbonyl R-2430 | | |
| Ctrl. 7 | 2.63 | 10.5 | 30.8 | 0.82 | " | 50:50 wt. ratio mix | 10, 9, 11 | 10 |
| Ex. 1 | 3.14 | 11.89 | 31.34 | 0.77 | Water Atom. | Atmix ® PF20E | 13, 11, 15, 13 | 13 |

[1]Ex. ISP Corporation;
[2]Ex. Hoeganes;
[3]Ex. Quebec Metal Powders

The particles used in accordance with the invention (Ex. 1) are slower in dry powder flow characteristics and surprisingly this correlates with improved MR fluid flow through orifices in a controllable device.

Example 1

A magnetorheological fluid is prepared by mixing 20% Atmix® PF20 E atomized iron powder ($D_{10}$=3.14 μm; $D_{50}$=11.89; $D_{90}$ =31.34 μm), and containing 99% iron, less than 1% oxygen, less than 1% nitrogen and 0.01% carbon, with 1% by wt. lithium hydroxy stearate, 1% by wt. molybdenum disulfide and the remaining volume 78% to 100% made up of a synthetic hydrocarbon oil carrier fluid derived from poly-α-olefins and sold under the name Durasyn® 162.

What is claimed is:

1. A magnetorheological fluid comprising a carrier fluid component and a magnetizable particle component wherein said magnetizable particle component is characterized by $D_{10}$ of 2 μm up to and including a $D_{10}$ of 5 μm, a $D_{50}$ of 8 μm up to and including $D_{50}$ of 15 μm; a $D_{90}$ of 25 μm to and including a $D_{90}$ of 40 μm; and further characterized by least squares regression ($R^2$) particles size against log normal cumulative volume percent of greater than or equal to 0.77.

2. The magnetorheological fluid of claim 1 wherein said carrier component is present in an amount of about 50 to about 95 volume percent of said magnetorheological fluid and said particle component is present in an amount of about 5 to about 50 volume percent of said magnetorheological fluid.

3. The magnetorheological fluid of claim 1 wherein said carrier component further comprises a dispersant.

4. The magnetorheological fluid of claim 1 further comprises a thixotropic agent selected from the group consisting of soap, colloidal silica, and organoclay.

5. The magnetorheological fluid of claim 4 wherein said thixotropic agent is an organoclay selected from organic modified bentonite.

6. The magnetorheological fluid of claim 1 further comprising an extreme pressure additive.

7. The magnetorheological fluid of claim 6 wherein said extreme pressure additive is selected from the group consisting of thiophosphorus compounds and thiocarbamates.

8. The magnetorheological fluid of claim 7 wherein said extreme pressure additive is an organophosphorous compound having the formula:

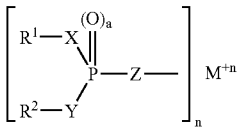

wherein $R^1$ and $R^2$ are each independently hydrogen, an amino group, or an alkyl group having 1 to 22 carbon atoms; X, Y and Z are each independently —$CH_2$—, a nitrogen heteroatom or an oxygen heteroatom, provided that at least one of X, Y or Z is an oxygen heteroatom; a is 0 or 1; and n is the valence of M; provided that if X, Y and Z are each an oxygen heteroatom, M is a salt moiety formed from an amine of the formula B:

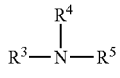

wherein $R^3$, $R^4$ and $R^5$ are each independently hydrogen or aliphatic groups having 1 to 18 carbon atoms; and, if at least one of X, Y or Z is not an oxygen heteroatom, M is selected from the group consisting of a metallic ion, a non-metallic moiety and a divalent moiety and if Z is a nitrogen heteroatom, then M is not an amine of formula B.

9. The magnetorheological fluid of claim 7 wherein said extreme pressure additive is a thiophosphorus compound having the structure

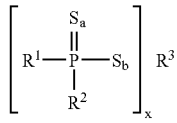

wherein $R^1$ and $R^2$ each individually have a structure represented by:

$$Y—((C)(R^4)(R^5))_{n—(O)w}—$$

wherein Y is hydrogen or a functional group—containing moiety such as an amino, amido, imido, carboxyl, hydroxyl, carbonyl, oxo or aryl;

n is an integer from 2 to 17 such that $C(R^4)(R^5)$ is a divalent group having a structure such as a straight-chained aliphatic, branched aliphatic, heterocyclic, or aromatic ring;

Rhu 4 and $R^5$ can each individually be hydrogen, alkyl or alkoxy; and w is 0 or 1.

10. The magnetorheological fluid of claim 7 wherein said extreme pressure additive is a thiocarbamate represented by the formula B:

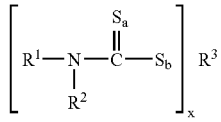

wherein $R^1$ and $R^2$ each individually have a structure represented by:

$$Y—((C)(R^4)(R^5))_n—$$

wherein Y is selected from hydrogen, amino, amido, imido, carboxyl, hydroxyl, carbonyl, oxo or aryl group; n is an integer from 2 to 17; $R^4$ and $R^5$ are individually hydrogen, alkyl or alkoxy groups; and $R^3$ is selected from the group consisting of a metal ion, a nonmetallic moiety, and a divalent moiety; a and b are each individually 0 or 1, provided a+b is at least equal to 1, and x is an integer from 1 to 5 depending upon the valence number of $R^3$.

11. The magnetorheological fluid of claim 1 wherein said particle component is selected from the group consisting of iron, iron oxide, iron nickel, iron cobalt, iron manganese, iron silicon, and iron boron.

12. The magnetorheological fluid of claim 3 wherein the dispersant is selected from an oleate, naphthenate, sulfonate, phosphate ester, stearic acid, stearate, glycerol monooleate, sorbitan sesquioleate, laurate, fatty acid and fatty alcohol.

13. The magnetorheological fluid of claim 12 wherein the dispersant comprises a stearate.

14. The magnetorheological fluid of claim 1 further comprising a molybdenum compound.

15. The magnetorheological fluid of claim 14 wherein said molybdenum compound is an organomolybdenum.

16. The magnetorheological fluid of claim 14 wherein the molybdenum compound is molybdenum disulfide.

17. The magnetorheological fluid of claim 1, wherein the carrier is a poly α-olefin.

18. A magnetorheological fluid comprising a 50 to 95 volume % of a carrier fluid component and 5 to 50 volume % of a magnetizable particle component wherein said magnetizable particle component is a single atomized process population characterized by $D_{10}$ of 2 μm up to and including a $D_{10}$ 5 μm, a $D_{50}$ of 10 μm up to and including a $D_{50}$ of 13 μm; a $D_{90}$ of 28 μm to and including a $D_{90}$ of 35 μm; and further characterized by least squares regression ($R^2$) particle size against log normal cumulative volume percent of greater than or equal to 0.77.

* * * * *